US005954021A

United States Patent [19]

Yuunaga

[11] Patent Number: 5,954,021

[45] Date of Patent: Sep. 21, 1999

[54] SUPPORT STRUCTURE FOR AN INTAKE MANIFOLD

[75] Inventor: Toshifumi Yuunaga, Hamamatsu, Japan

[73] Assignee: Suzuki Motor Corporation, Japan

[21] Appl. No.: 08/822,776

[22] Filed: Mar. 21, 1997

[30] Foreign Application Priority Data

May 16, 1996 [JP] Japan ..... 8-146609

[51] Int. Cl.[6] ..... F02M 35/10

[52] U.S. Cl. ..... 123/184.42

[58] Field of Search ..... 123/184.42, 184.47

[56] References Cited

FOREIGN PATENT DOCUMENTS 1-99965 4/1989 Japan .

*Primary Examiner*—Noah P. Kamen

*Attorney, Agent, or Firm*—Finnegan, Henderson, Farabow, Garrett & Dunner

[57] ABSTRACT

An object of a support structure for an intake manifold in accordance with the present invention is to reduce the number of parts and to improve the space efficiency. To achieve the object, the support structure is so configured that a surge tank 3 and a flange 4 are connected to each other by means of a stay member 23, by which the rigidity of the intake manifold 21 is enhanced, and EGR gas is introduced into the surge tank 3 via the stay member 23.

4 Claims, 4 Drawing Sheets

SUPPORT STRUCTURE FOR AN INTAKE MANIFOLD

FIELD OF THE INVENTION AND RELATED ART STATEMENT

The present invention relates to a support structure for an intake manifold having a surge tank, which is mounted on an engine with a fuel injecting device.

Generally, on an engine with a fuel injecting device, a part of intake air passage is expanded by providing a surge tank at the collecting part of intake pipes of intake manifold to prevent intake air pulsation and intake air interference between cylinders.

A conventional support structure for an intake manifold having a surge tank will be described with reference to FIG. 7. In an intake manifold 1 shown in FIG. 7, which is for an in-line four-cylinder engine, a surge tank 3 is integrally provided at one end of four intake pipes 2 which are bent into a substantially L shape, and four intake pipes 2 are collected by the surge tank 3. The other end of four intake pipes 2 is connected to a cylinder head of an engine body (not shown) via a flange 4 so as to face an intake port for each cylinder provided in the cylinder head.

The intake pipe 2 of the intake manifold 1 is provided with a fuel injector 6, and a fuel delivery pipe 7 is connected to the fuel injector 6. Also, a flange 8 for attaching a throttle body (not shown) is formed at an opening at one end of the surge tank 3.

The intake manifold 1 is fixed to the engine body by bringing the flange 4 into contact with the attaching portion of cylinder head, by inserting stud bolts (not shown) provided on the cylinder head in screw holes 9 formed in the flange 4, and by screwing nuts (not shown), so that the intake pipe 2 communicates with the intake port of cylinder head.

A reinforcing stay 10 is installed to the intake manifold 1 to connect the surge tank 3 to the flange 4 of intake pipes 2. One end of the reinforcing stay 10 is connected to the end of the surge tank 3 on the opposite side to the flange 8 for attaching the throttle body, and the other end thereof is connected to the upper end at one end of the flange 4 of intake pipe 2 with a bolt 12. By connecting the surge tank 3 provided at one end of the intake pipe 2 to the flange 4 provided at the other end thereof using the reinforcing stay 10, the rigidity of the intake manifold 1 is enhanced, which restrains the occurrence of vibration and noise caused by engine operation.

The intake manifold 1 is provided with an EGR (Exhaust Gas Recirculation) pipe 13 for recirculating part of exhaust gas of engine (EGR gas) into the surge tank 3. The EGR pipe 13 is a metal pipe, one end of which is connected to an EGR passage 14 formed at one end of the flange 4 of intake pipes 2 by using a union nut 15. Further, the EGR pipe 13 is bent toward the central part of the surge tank 3, and the other end thereof is connected to an EGR valve 16 (the state thereof before installation is shown) installed to the surge tank side wall by a union nut 17, so that the EGR pipe 13 communicates with the interior of the surge tank 3 via the EGR valve 16. The EGR valve 16 is installed to a boss 18 formed at the side face of the surge tank 3 on the engine body side via a gasket 19 using bolts 20.

As described above, the support structure for the intake manifold in which the surge tank is connected to the flange of intake pipes by a stay is disclosed, for example, in Unexamined Japanese Utility Model Publication No. 1-99965.

However, the conventional support structure for the intake manifold 1 shown in FIG. 7 presents problems as described below. Between the intake pipe 2 and surge tank 3 of the intake manifold 1 and the engine body are arranged many parts such as the fuel injectors 6, fuel delivery pipe 7, EGR pipe 13, and EGR valve 16. Therefore, if the reinforcing stay 10 is arranged in this space, a space limitation exists, and the work ability for assembling is poor. Further, the installation of the reinforcing stay 10 increases the number of parts, resulting in a higher manufacturing cost.

OBJECT AND SUMMARY OF THE INVENTION

The present invention was made in view of the above situation, and accordingly an object of the present invention is to provide a support structure for an intake manifold which can reduce the number of parts and can improve the efficiency of space utilization in the engine.

To solve the above problems, the invention of claim 1 provides a support structure for an intake manifold integrally formed with an intake pipe, a surge tank with which one end of the intake pipe communicates, and a flange for connecting the other end of the intake pipe to a cylinder head, in which the surge tank and the flange are connected to each other by means of a pipe-shaped stay member, and an EGR passage is formed by the stay member.

By this configuration, the rigidity of the intake manifold can be enhanced by the stay member, and EGR gas is allowed to flow via the stay member. Also, by using the stay member as both a reinforcing stay for the intake manifold and an EGR passage, the number of parts can be reduced, and the space efficiency can be improved.

The support structure according to the invention of claim 2 is, in addition to the above-described configuration of claim 1, so configured that the stay member extends along the side wall of the surge tank from the connecting portion with the surge tank, and the end thereof is connected to the surge tank.

By this configuration, the position of portion where the EGR passage is connected to the surge tank can be set freely despite the position of portion where the stay member is connected to the intake manifold.

The support structure according to the invention of claim 3 is, in addition to the above-described configuration of claim 1, so configured that the stay member is bent substantially into an L shape, and the bent portion is welded to the end of the surge tank on the opposite side to a flange for attaching a throttle body.

This configuration enables the stay member and the intake manifold to be connected to each other more rigidly.

Further, the support structure according to the invention of claim 4 is, in addition to the above-described configuration of any one of claims 1 to 3, so configured that the stay member is welded to the intake manifold body.

In this configuration, the stay member is integrated with the intake manifold by welding.

DETAILED DESCRIPTION OF PREFERRED EMBODIMENTS

Figure 1:
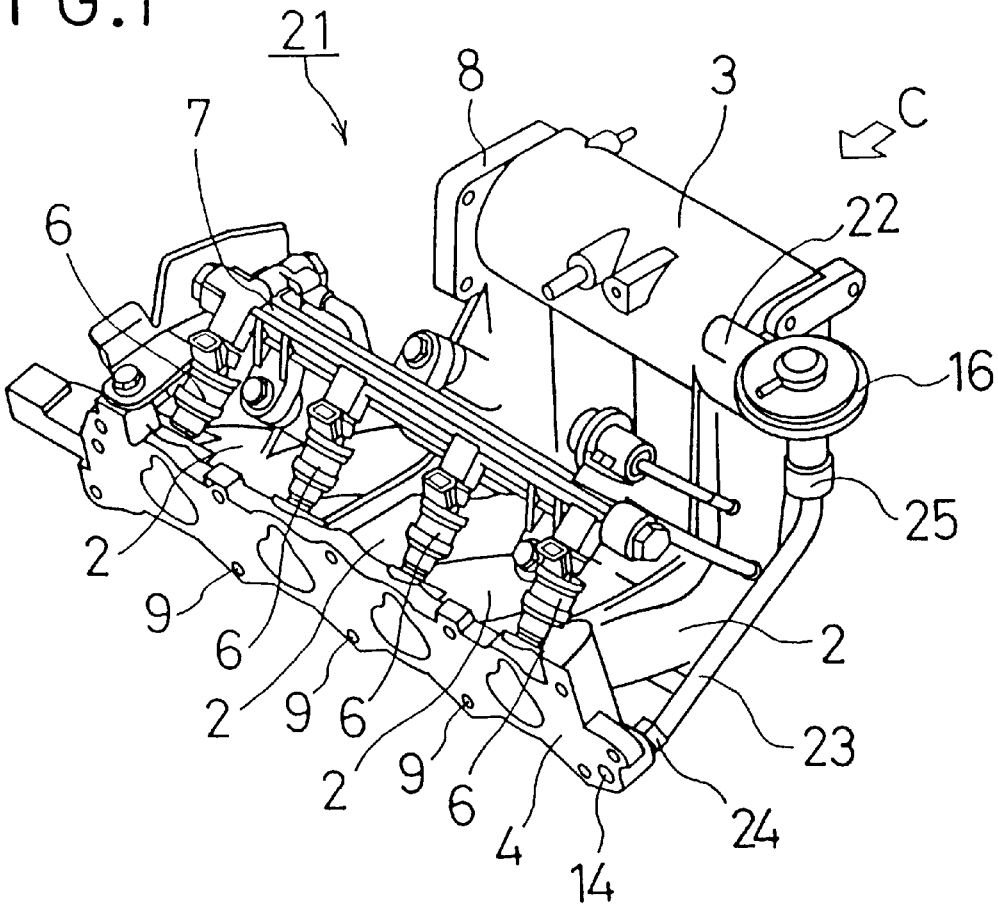
FIG. 1 is a perspective view of an intake manifold in accordance with a first embodiment of the present invention.

Embodiments of the present invention will be described in detail with reference to the accompanying drawings. Support structures for an intake manifold in accordance with the embodiments generally have the same construction as that of the conventional support structure shown in FIG. 7 except the reinforcing stay, EGR pipe, and EGR valve. Therefore, the same reference numerals are applied to the same-elements as those in FIG. 7, and only different elements are explained in detail.

Figure 2:
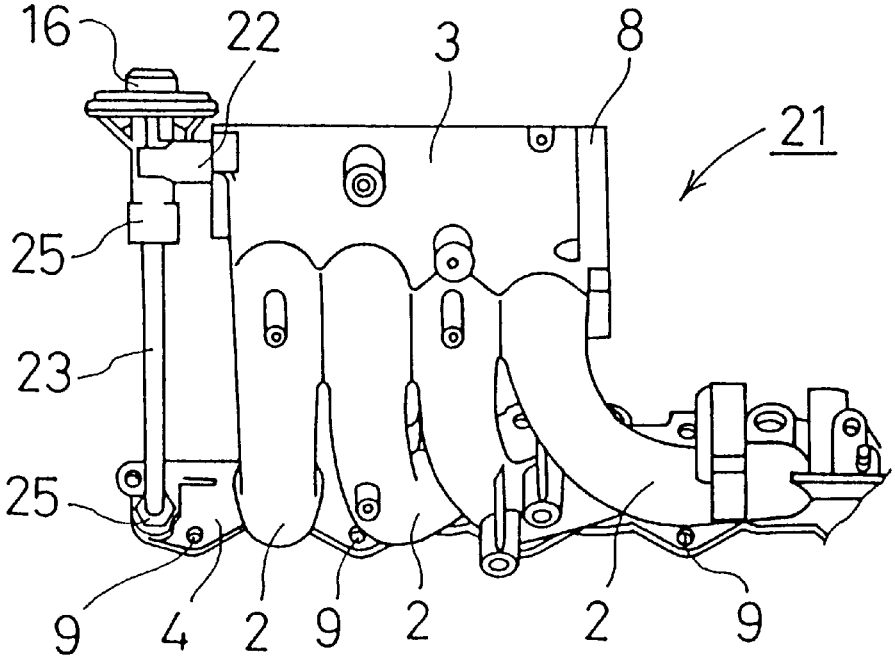
FIG. 2 is a view taken in the direction of arrow C in FIG. 1.
Figure 7:
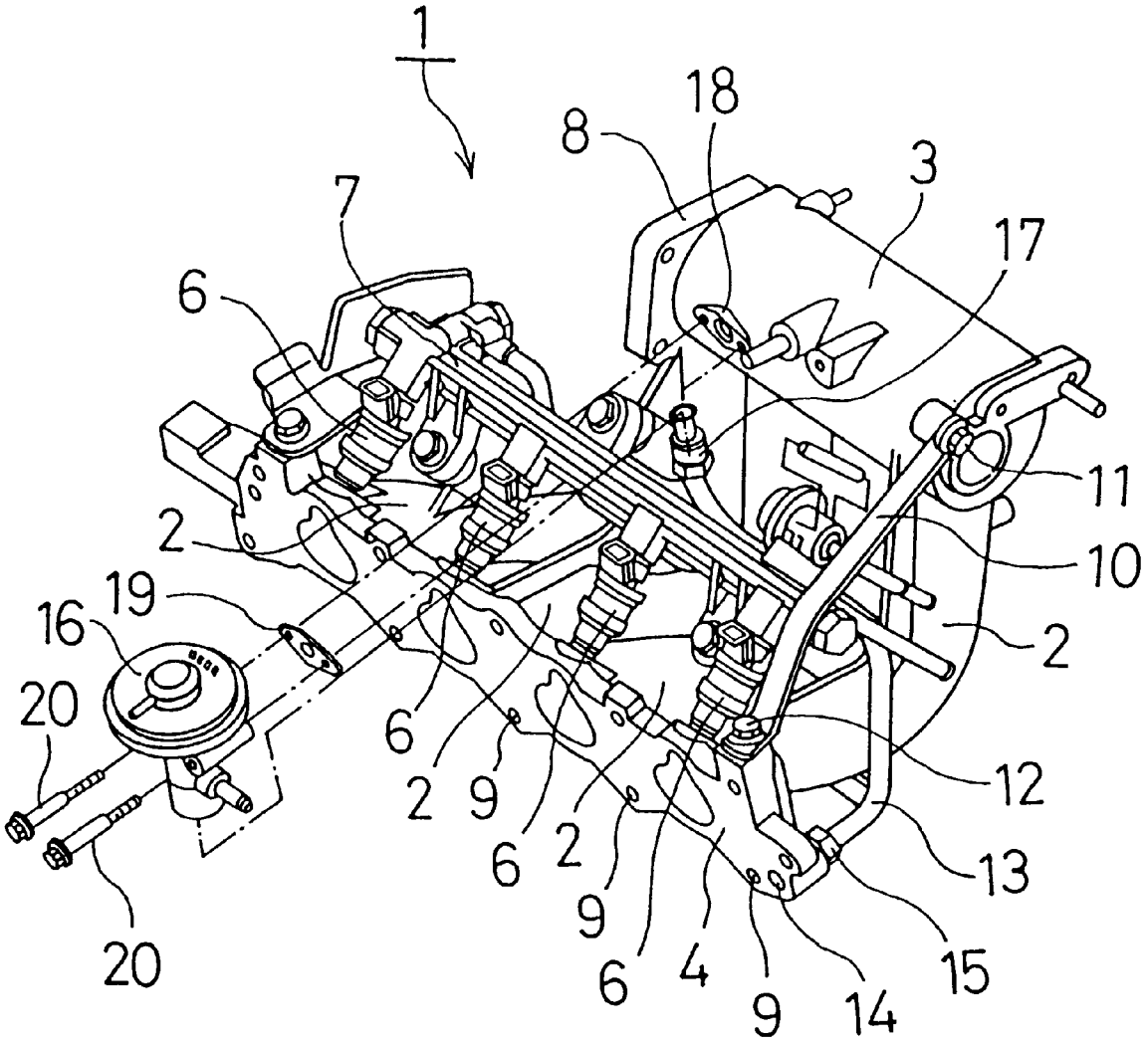
FIG.7 (RELATED ART)
FIG. 7 is a perspective view showing a conventional support structure for an intake manifold.

A support structure for an intake manifold in accordance with a first embodiment of the present invention will be described with reference to FIGS. 1 and 2. As shown in FIGS. 1 and 2, an intake manifold 21 in accordance with the first embodiment is not provided with a reinforcing stay 10, EGR pipe 13, and boss 18, which are shown in FIG. 7. An EGR valve 16 in the intake manifold 21 is attached to a boss 22 formed at the end of a surge tank 3 on the opposite side to a flange 8 for attaching a throttle body. A flange 4 of intake pipes 2 and the surge tank 3 are connected to each other by a pipe-shaped stay member 23.

One end of the stay member 23 is connected to an EGR passage 14 formed in the flange 4 of intake pipes 2 using a union nut 24. The other end of the stay member 23, which is connected to the EGR valve 16 using a union nut 25, communicates with the interior of the surge tank 3 via the EGR valve 16.

Since the surge tank 3 on one side of the intake pipes 2 and the flange 4 on the other side thereof are connected to each other by the stay member 23 in such a manner, the rigidity of the intake manifold 21 can be enhanced, so that the occurrence of vibration and noise caused by engine operation can be restrained. Also, EGR gas can be introduced into the surge tank 3 through an EGR passage 14 via the EGR valve 16 and the pipe-shaped stay member 23.

Also, since the stay member 23 is used as both a reinforcing stay for the intake manifold 21 and an EGR flow path, the number of parts can be reduced, and the space efficiency can be improved. Further, the EGR passage 14, which is the connecting portion on the flange 4 side of the stay member 23, and the EGR valve, which is the connecting portion on the surge tank 3 side, are arranged on a straight line so that the stay member 23 is of a straight-line shape. As a result, the rigidity of the intake manifold 21 can be enhanced effectively.

Figure 3:
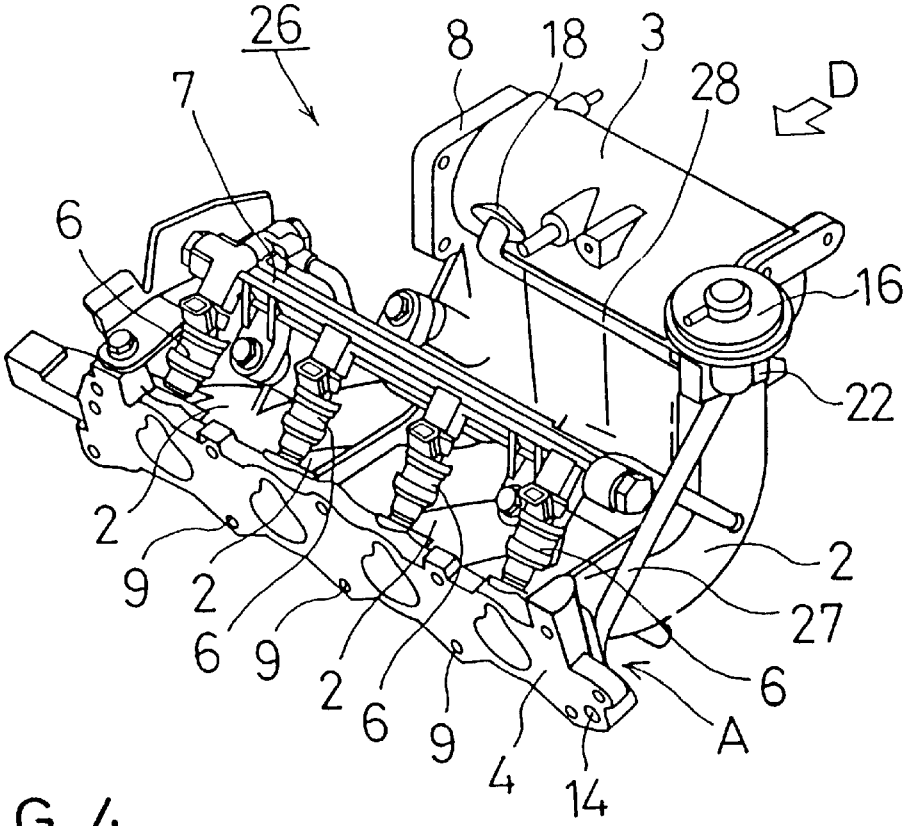
FIG. 3 is a perspective view of an intake manifold in accordance with a second embodiment of the present invention.
Figure 4:
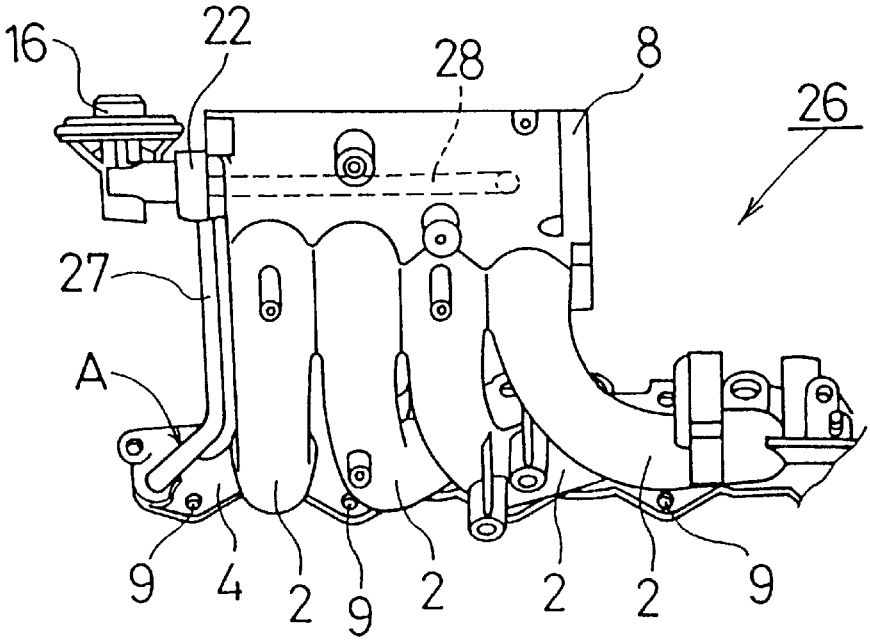
FIG. 4 is a view taken in the direction of arrow D in FIG. 3.

Next, a support structure for an intake manifold in accordance with a second embodiment of the present invention will be described with reference to FIGS. 3 and 4. In an intake manifold 26 in accordance with the second embodiment, the EGR valve 16 is attached to the boss 22 formed at the end of the surge tank 3 on the opposite side to the flange 8 for attaching a throttle body as in the above-described first embodiment. The flange 4 of intake pipes 2 and the surge tank 3 are connected to each other by a pipe-shaped stay member 27.

A portion of the stay member 27 in the vicinity of one end thereof is joined to the flange 4 of intake pipes 2 by welding, brazing, etc. so that the end of the stay member 27 is connected to the EGR passage 14 (the joined portion is indicated by A). The other end of the stay member 27 is joined to the boss 22 for attaching the EGR valve 16 by welding, brazing, etc. so as to be connected to the EGR valve 16. An EGR extension pipe 28 extends along the side wall of surge tank 3 on the engine body side from the EGR valve 16, and the end thereof is connected to a boss 18 of the surge tank 3. Thereupon, the stay member 27 communicates with the interior of the surge tank 3 via the EGR valve and the EGR extension pipe 28.

Since the stay member 27 is joined integrally to the intake manifold 26, and the surge tank 3, which is on one end side of intake pipes 2, and the flange 4, which is on the other end side thereof, are connected to each other by the stay member 27 so that the rigidity of the intake manifold 26 can be enhanced, and the occurrence of vibration and noise caused by engine operation can be restrained. Also, EGR gas can be introduced into the surge tank 3 through an EGR passage 14 via the EGR valve 16 by means of the pipe-shaped stay member 27 and the EGR extension pipe 28.

Also, since the stay member 27 is used as both a reinforcing stay for the intake manifold 26 and an EGR flow path, the number of parts can be reduced, and the space efficiency can be improved. Further, the joined portion A on the flange 4 side of the stay member 27 and the boss 22, which is the joined portion on the surge tank 3 side, are arranged on one straight line. These two components are connected to each other by a straight-line intermediate portion of the stay member so that the rigidity of the intake manifold 26 can be enhanced effectively regardless of the positions of connecting portions at both ends of the stay member 27.

Figure 5:
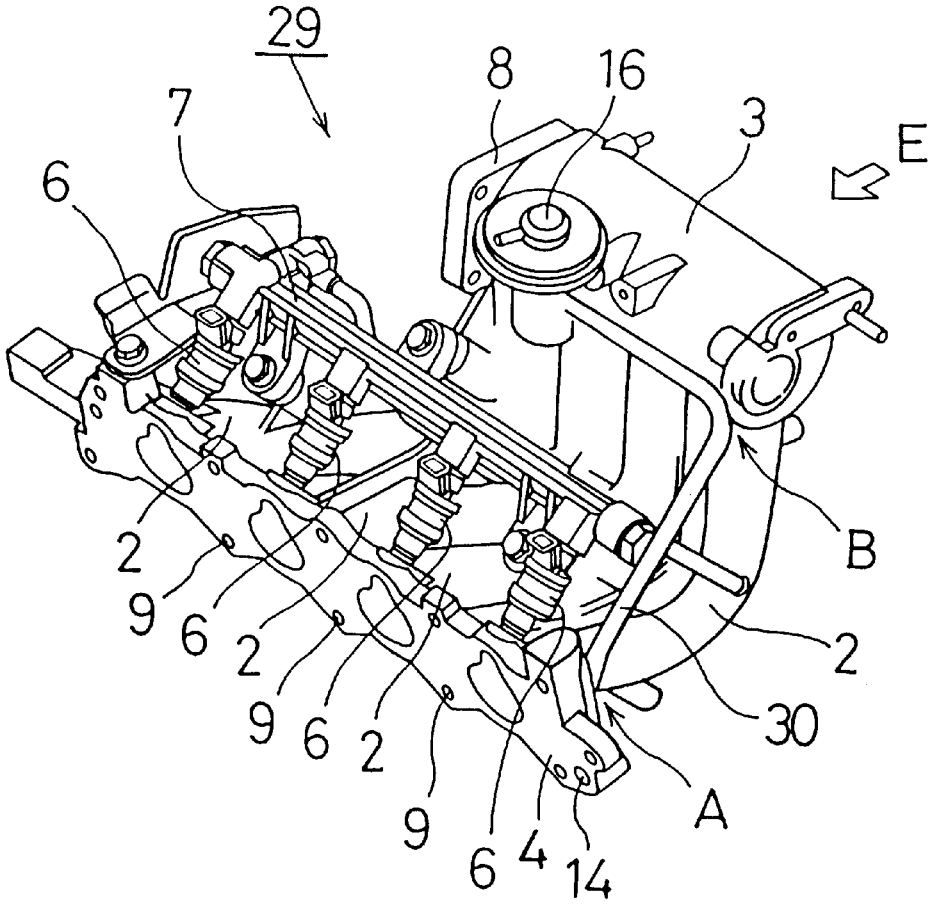
FIG. 5 is a perspective view of an intake manifold in accordance with a third embodiment of the present invention.
Figure 6:
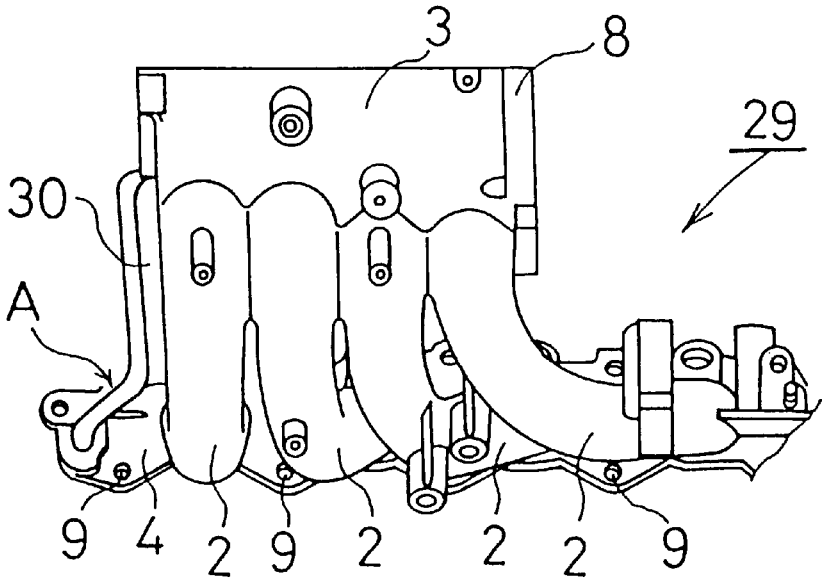
FIG. 6 is a view taken in the direction of arrow E in FIG. 5.

Next, a support structure for an intake manifold in accordance with a third embodiment of the present invention will be described with reference to FIGS. 5 and 6. In an intake manifold 29 in accordance with the third embodiment, the EGR valve 16 is attached to the boss 18 formed at the side of the surge tank 3 as in the intake manifold 21 shown in FIG. 7. The flange 4 of intake pipes 2 and the surge tank 3 are connected to each other by a pipe-shaped stay member 30 bent substantially into an L shape.

A portion of the stay member 30 in the vicinity of one end thereof is joined to the flange 4 of intake pipes 2 by welding, brazing, etc. so that the end of the stay member 30 is connected to the EGR passage 14 (the joined portion is indicated by A). The stay member 30 extends in a straight-line shape to a bent portion B toward the end of the surge tank 3 on the opposite side to the flange 8 for attaching a throttle body, and is joined to the surge tank 3 at the bent portion B by welding or brazing. Further, a portion of the stay member 30 from the bent portion B to the other end thereof extends along the side wall of the surge tank 3 on the engine body side, and the other end thereof is connected to the EGR valve 16. Thereupon, the stay member 30 communicates with the interior of the surge tank 3 via the EGR valve 16.

Since the stay member 30 is joined integrally to the intake manifold 29, and the surge tank 3, which is on one end side of intake pipes 2, and the flange 4, which is on the other end side thereof, are connected to each other by the straight-line portion of the stay member 30 in such a manner, the rigidity of the intake manifold 29 can be enhanced, so that the occurrence of vibration and noise caused by engine operation can be restrained. Also, EGR gas can be introduced into the surge tank 3 through the EGR passage 14 via the EGR valve 16 and the pipe-shaped stay member 30.

Also, since the stay member 30 is used as both a reinforcing stay for the intake manifold 29 and an EGR flow path, the number of parts can be reduced, and the space efficiency can be improved. Further, since the joined portion A on the flange 4 side of the stay member 30 and the joined portion B on the surge tank 3 side are connected to each other by a straight-line portion of the stay member 30, the rigidity of the intake manifold 26 can be enhanced effectively. Further, since the stay member 30 extends along the side wall of the surge tank 3 from the joined portion B (connecting portion) to be connected to the surge tank 3, the position of portion where the stay member 30 is connected to the surge tank 3 can be set freely despite the position of portion where the stay member 30 is connected to the body of the intake manifold 29, so that the degree of freedom for arranging the stay member 30 as the EGR passage can be increased.

In the second and third embodiments, the intake manifold body and the stay member are made of the same material, preferably, for example, a steel having high weldability, by which welding can be performed easily, and sufficient strength can be secured easily after welding.

In the support structure for the intake manifold according to the invention, the surge tank and the flange of the intake pipes are connected to each other by a pipe-shaped stay member. The stay member also forms an EGR passage so that the rigidity of the intake manifold can be enhanced by the stay member while providing a path for EGR gas. By using the stay member as both a reinforcement for the intake manifold and an EGR flow path, the number of parts can be reduced, increasing the space utilization efficiency in the engine.

According to the invention, the stay member extends along the side wall of the surge tank from the portion where it is attached to the surge tank, to the end of the stay member, which is connected to the surge tank. This arrangement lets the position of the connection between the EGR passage and the surge tank to be selected freely, even if the position of the portion where the stay member is attached to the intake manifold is fixed, so that the degree of freedom for arranging the EGR passage can be increased.

In the support structure for the intake manifold according to the invention, the stay member and the intake manifold can be connected to each other more rigidly and the stay member can be integrated with the intake manifold by welding.

I claim:

1. A support structure for an intake manifold integrally formed with an intake pipe, a surge tank with which one end of said intake pipe communicates, and a flange for connecting the other end of said intake pipe to a cylinder head, in which said surge tank and said flange are connected to each other by means of a pipe-shaped stay member, and an EGR passage is formed by said stay member.

2. A support structure for an intake manifold according to claim 1, wherein said stay member extends along the side wall of said surge tank from the connecting portion with said surge tank, and the end thereof is connected to said surge tank.

3. A support structure for an intake manifold according to claim 1, wherein said stay member is bent substantially into an L shape, and the bent portion is welded to the end of said surge tank on the opposite side to a flange for attaching a throttle body.

4. A support structure for an intake manifold according to any one of claims 1 to 3, wherein said stay member is welded to the intake manifold body.

* * * * *